United States Patent [19]

Inoue et al.

[11] Patent Number: 4,629,412

[45] Date of Patent: Dec. 16, 1986

[54] HOT ISOSTATIC PRESSING APPARATUS

[75] Inventors: Yoichi Inoue, Ashiya; Takahiko Ishii, Kobe, both of Japan

[73] Assignee: Kabushiki Kaisha Kobe Seiko Sho, Kobe, Japan

[21] Appl. No.: 639,065

[22] Filed: Aug. 9, 1984

[30] Foreign Application Priority Data

Aug. 11, 1983 [JP] Japan ..... 58-125126[U]

[51] Int. Cl.[4] ..... B22F 3/12

[52] U.S. Cl. ..... 425/405 H; 266/252; 419/49; 425/DIG. 26

[58] Field of Search ..... 425/78, 77, DIG. 26, 425/405 H, 405 R; 419/49; 266/251-255; 432/247, 249

[56] References Cited

U.S. PATENT DOCUMENTS

| | | | |
|---|---|---|---|
| 3,571,850 | 3/1971 | Pohto | 425/405 H |
| 4,013,394 | 3/1977 | Witkin et al. | 425/405 H |
| 4,022,446 | 5/1977 | Smith, Jr. et al. | 266/251 |
| 4,151,400 | 4/1979 | Smith, Jr. et al. | 425/405 H |
| 4,217,087 | 8/1980 | Bowles | 425/405 H |
| 4,235,592 | 11/1980 | Smith, Jr. et al. | 266/251 |
| 4,247,755 | 1/1981 | Smith, Jr. et al. | 425/405 H |
| 4,471,949 | 9/1984 | Ishii | 425/405 H |
| 4,491,302 | 1/1985 | Asari et al. | 425/405 H |

*Primary Examiner*—Jay H. Woo
*Assistant Examiner*—J. Fortenberry
*Attorney, Agent, or Firm*—Oblon, Fisher, Spivak, McClelland & Maier

[57] ABSTRACT

A hot isostatic pressing apparatus having a high pressure vessel, a heat insulating layer and a heater disposed inside the heat insulating layer, the heat insulating layer and the heater being disposed within a high pressure chamber defined by upper and lower covers. The heat insulating layer is composed of at least two inner and outer inverted cup-like casings, the outer casing being metallic and having a hermetic structure and the inner casing having a hermetic structure. A passage is formed in the upper surface of the outer casing and a valve capable of being opened and closed is provided therein. Further, a mechanism for opening and closing the valve is mounted on the upper cover, and a gas passage is formed in the lower portion of the het insulating layer. The above arrangement creates a convection of gas in the cooling step after the HIP treatment whereby a remarkable improvement can be attained in cooling efficiency, cooling time and productivity.

5 Claims, 5 Drawing Figures

HOT ISOSTATIC PRESSING APPARATUS

BACKGROUND OF THE INVENTION

1. Field of the Invention

The present invention relates to an apparatus for use in a hot isostatic pressing (hereinafter referred to simply as "HIP") treatment and, more particularly, to the same apparatus capable of shortening the cooling time after completion of HIP treatment thereby improving the operating efficiency.

2. Description of the Prior Art

Heretofore, an HIP apparatus has been basically composed of a high pressure vessel, a heat insulating layer and heater disposed inside the heat insulating layer, both the heat insulating layer and the heater being disposed within a high pressure chamber defined by upper and lower covers. In view of the importance of heat insulating and soaking performances, various improvements have been proposed in connection with an HIP apparatus as disclosed, for example, in Japanese Patent Publication Nos. 50276/80 and 53276/83.

On the other hand, since this HIP treatment involves the drawback that a long time is required for the execution of a single cycle, efforts have been demanded for rationalization of the entire process, and there has been developed what is called a modular type HIP system including a plurality of stations such as a cooling/-preheating station and preparatory station.

However, one important factor in HIP treatment is cooling, and it is apparent that cooling has a great influence upon an efficient utilization of an HIP apparatus. For this reason, various improvements and the development of new systems have been made as mentioned above. Particularly as to HIP apparatus per se, improvements have been made with respect to the structure of the heat insulating layer and that of heater. But, there have been made few attempts to enhance the cooling effect, especially to enhance the cooling effect while circulating a high pressure gas.

SUMMARY OF THE INVENTION

Taking note of the above point, the present inventors have recently studied shortening the cooling time by utilization of microconvection of gas in a furnace chamber.

It is well known that the heat transfer system is classified into the following three types—convection, radiation and conduction. But, under high temperature and pressure in an HIP apparatus, convection is the main heat transfer means. Therefore, in order to shorten the cooling time in an HIP apparatus, it is effective to utilize a convectional gas flow.

Therefore, in order to enhance the cooling efficiency and thereby shorten the cooling time in HIP apparatus, the present inventors have conducted studies and have determined that the cooling time can be shortened to a large extent by providing an on-off valve in a heat insulating layer, forming a gas passage in the lower end portion of the heat insulating layer and opening the valve to create macroconvection of gas in the cooling step which follows the HIP treatment.

More specifically, the present invention is characterized in that in the above HIP apparatus, the heat insulating layer includes at least two inner and outer inverted cup-like casings, the outer casing being formed of a metal and having a hermetic structure and the inner casing also having a hermetic structure; a passage including an on-off valve is formed in the upper surface or upper end portion of the outer casing and means for opening and closing the said valve are mounted on an upper cover; and a gas passage is formed in the lower portion of the heat insulating layer including the lower end portions of the inner and outer inverted cup-like casing.

It is necessary that the outer casing be principally formed of a metal and have a hermetic structure. The inner casing should have a hermetic structure and is formed of, for example, stainless steel, nickel alloy, molybdenum or graphite according to temperature conditions.

These two inner and outer casings are a minimum number of casings; that is, an additional inverted cup-like casing or casings may be provided therebetween, and/or a heat insulating material such as a graphitic material, ceramic fiber or metal may be packed between the casings to ensure the required heat insulating performance.

Regardless of whether the inverted cup-like casings are two inner and outer casings or three or more casings with additional casing or casings disposed therebetween, the lower end portions of those casings are hermetically connected together through a metallic ring, for example, by a full-circled welding.

A important constructional point of the present invention resides in that in a high pressure chamber having the above-described heat insulating layer, the convection of gas in the same layer is suppressed during treatment at high temperature and pressure to allow good heat insulating performance to be exhibited, while in the cooling step after the HIP treatment, a macroconvection of gas in created in the same chamber to enhance the cooling efficiency.

To this end, even if a cooling jacket is usually provided around the high pressure vessel, there is further formed a gas passage for the convection of gas through the heat insulating layer. In the case where the heat insulating layer comprises two inner and outer inverted cup-like casings, such gas passages are usually formed in the lower end portion of the outer casing regardless of whether a heat insulating material is packed between both casings or not. This is suitable in point of design. But, where the heat insulating layer is composed of three (i.e. inner, middle and outer) inverted cup-like casings, it is suitable to provide such gas passage either in the lower end portion of the inner casing or in the metallic ring in a position between the inner and middle casings which ring connects the lower ends of the casing, regardless of whether a heat insulating material is present or not. In this case, it is necessary to provide a gas passage for communicating with each other the space formed between the inner and middle casings and that formed between the middle and outer casings. Therefore, a gas passage for communication is formed in the upper surface or upper end portion of the middle casing.

Further, in corresponding relation to the above gas passage there is formed an upper passage in the upper surface of the outer casing, in which upper passage is provided an on-off valve for inhibiting or permitting the convection of gas. Details on this valve, including a concrete structure, have already been proposed separately, so are omitted here, but basically this valve is opened and closed by means of a drive unit such as a hydraulic cylinder attached to the upper cover.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Embodiments of the present invention will be described hereinbelow with reference to the accompanying drawings.

Figure 1:
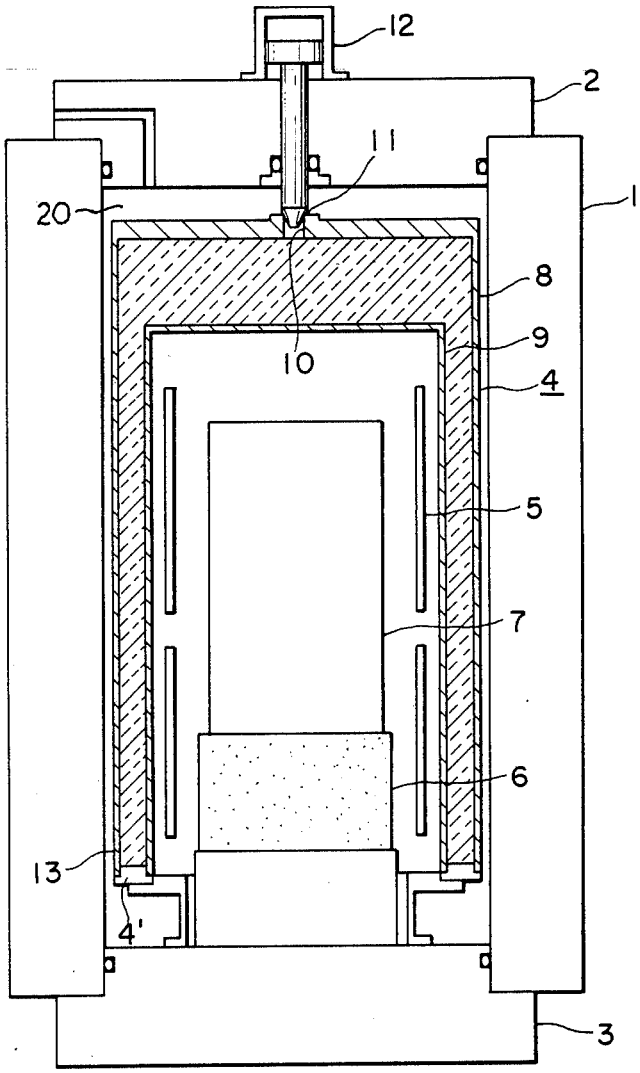
FIGS. 1 and 2 are schematic sectional views of an HIP apparatus according to an embodiment of the present invention.
Figure 2:
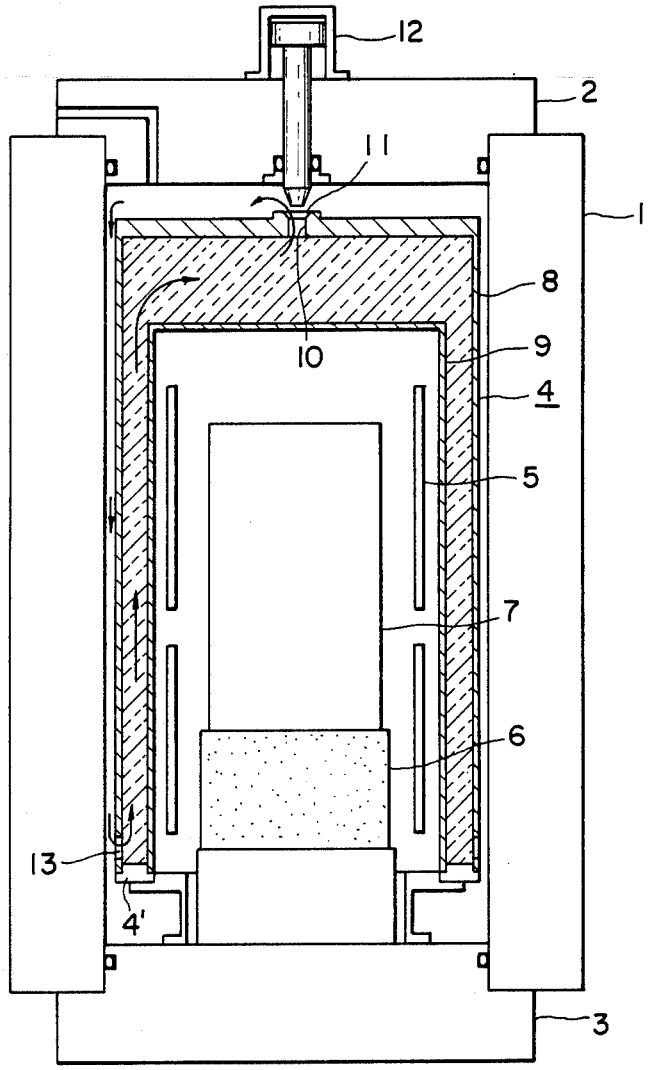
Figure 3:
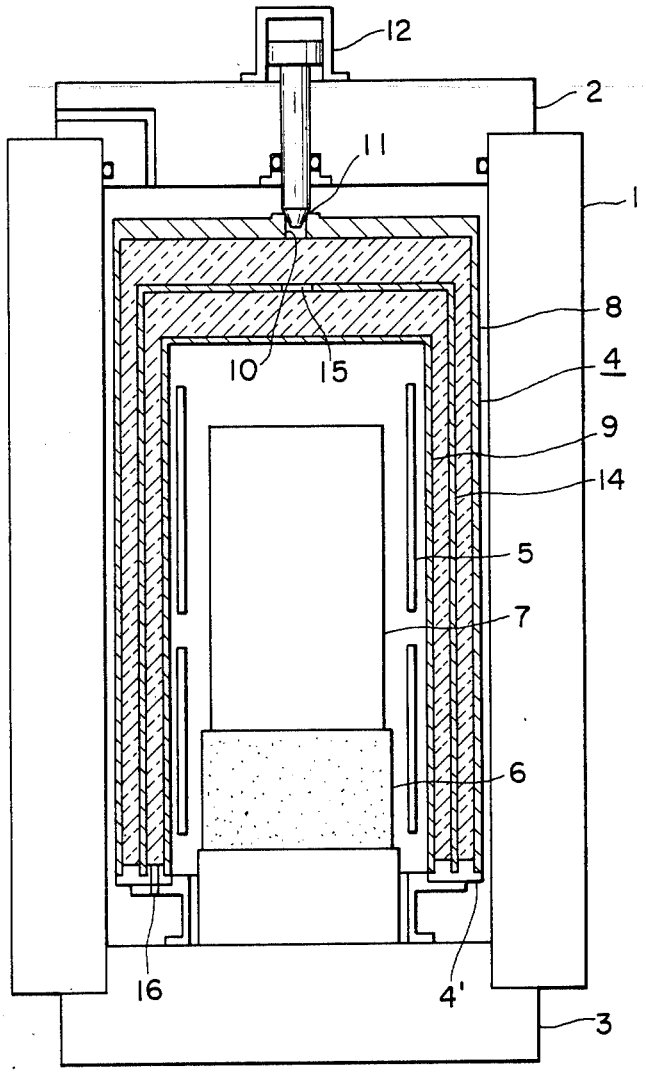
FIGS. 3 and 4 are schematic sectional views of an HIP apparatus according to another embodiment of the invention.
Figure 4:
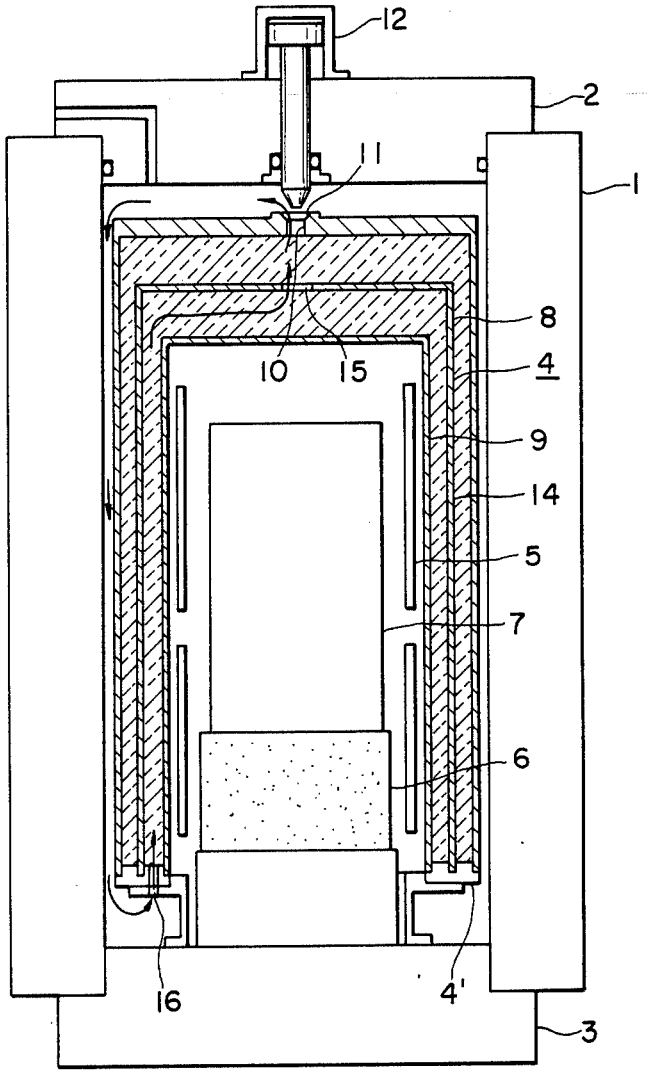

FIGS. 1 and 2 illustrate an embodiment of the present invention, and FIGS. 3 and 4 illustrate a modified embodiment thereof.

In FIGS. 1 and 2, numerals 1, 2 and 3 denote a high pressure vessel, an upper cover and a lower cover, respectively, whereby a high pressure chamber is defined, in which are enclosed a heat insulating layer 4 and a heater 5 disposed inside the heat insulating layer. This is a basic construction of the HIP apparatus of the present invention. On the lower cover 3 is provided a hearth 6, on which is put a work piece 7, as shown in the figures, and in this condition there is performed HIP treatment.

In the embodiment being considered, the heat insulating layer is composed of two inverted cup-like casings 8 and 9, which are hermetically connected at the respective lower ends to a metallic ring 4' by welding or other suitable means. A heat insulating material may be packed between the casings 8 and 9.

The outer casing 8 is metallic and is made hermetic by welding as mentioned above. A passage 10 is formed substantially centrally in the upper surface of the outer casing 8 is that it can be opened and closed with vertical movements of a valve 11 attached to a shaft end of a drive unit 12 such as a hydraulic cylinder which is mounted on the upper cover 2. Moreover, in the lower end portion of the outer casing 8 is formed a gas passage 13 for communication between the heat insulating layer 4 and the interior of the high pressure chamber 20 filled with gas. The position of the gas passage 13 is not restricted to the illustrated position; it may at be any position capable of promoting convection. Likewise, the place where the passage 10 is formed is not always restricted to the upper surface of the outer casing; the passage 10 may be formed in any upper position.

On the other hand, the inner casing 9 opposed to the outer casing 8 is of a hermetic structure, of course, and preferably is formed of a heat- and pressure-resistant material because it is exposed to the high temperature and pressure in the interior of the treating chamber, which material is selected according to temperature conditions.

In this apparatus, HIP treatment is performed according to a conventional technique, during which treatment the passage 10 in the upper surface of the outer casing is closed with the valve 11 (see FIG. 1). Then, in transferring to the cooling step after completion of the HIP treatment, the valve 11 moves upward as shown in FIG. 2, so that the upper passage 10 opens. This operation usually is performed automatically by sequence control.

As the valve 11 moves up and the passage 10 opens, the gas is heated as indicated with arrows in FIG. 2 and becomes lighter at a high temperature. The thus-lightened high temperature gas rises through the heat insulating layer 4, passes through the upper passage 10 and flows out of the heat insulating layer 4, then is cooled by the inner surface of the high pressure vessel 1 and becomes heavier, then flows down and again into the heat insulating layer 4 through the lower gas passage 13, thus defining a route of a macroconvection of gas whereby the heat is absorbed efficiently to promote the cooling effect.

In this connection, there usually is provided a safety device whereby when the inner surface temperature of the high pressure vessel 1 reaches a predetermined level, e.g. 150° C., the valve 11 is brought down automatically to close the upper passage 10.

Referring now to FIGS. 3 and 4, there is illustrated another embodiment of the present invention, in which there is used a heat insulating layer 4 composed of inner and outer inverted cup-like casings 8 and 9 and a like casing 14 interposed therebetween, with a gas passage 15 being formed in the upper surface of the casing 14. Further, a gas passage 16 for communication between the heat insulating layer 4 and the space in the high pressure chamber outside the heat insulating layer is formed in a metallic ring 4' in a position between the inner casing 9 and the middle casing 14 which ring hermetically connects the lower end portions of the casings 8, 14 and 9, provided the position where the gas passage 16 is formed may be a lower end position of the inner casing 9.

Under such arrangement, the convection of gas is performed in the following manner. Upon opening of valve 11 as indicated by the arrows in FIG. 4 a high temperature gas rises between the inner and middle casings 9 and 14, passes through the passages 15 and 10 and flows out of the heat insulating layer 4, then is cooled by the inner surface of the high pressure vessel 1 and so goes down, then passes through the lower gas passage 16 and again flows into the space between the inner and middle casings 9 and 14, thus forming an ascending and descending route.

In FIGS. 3 and 4 the same reference numerals, as in FIGS. 1 and 2 represent the same elements, and the attachments are also the same as in the previous embodiment.

Figure 5:
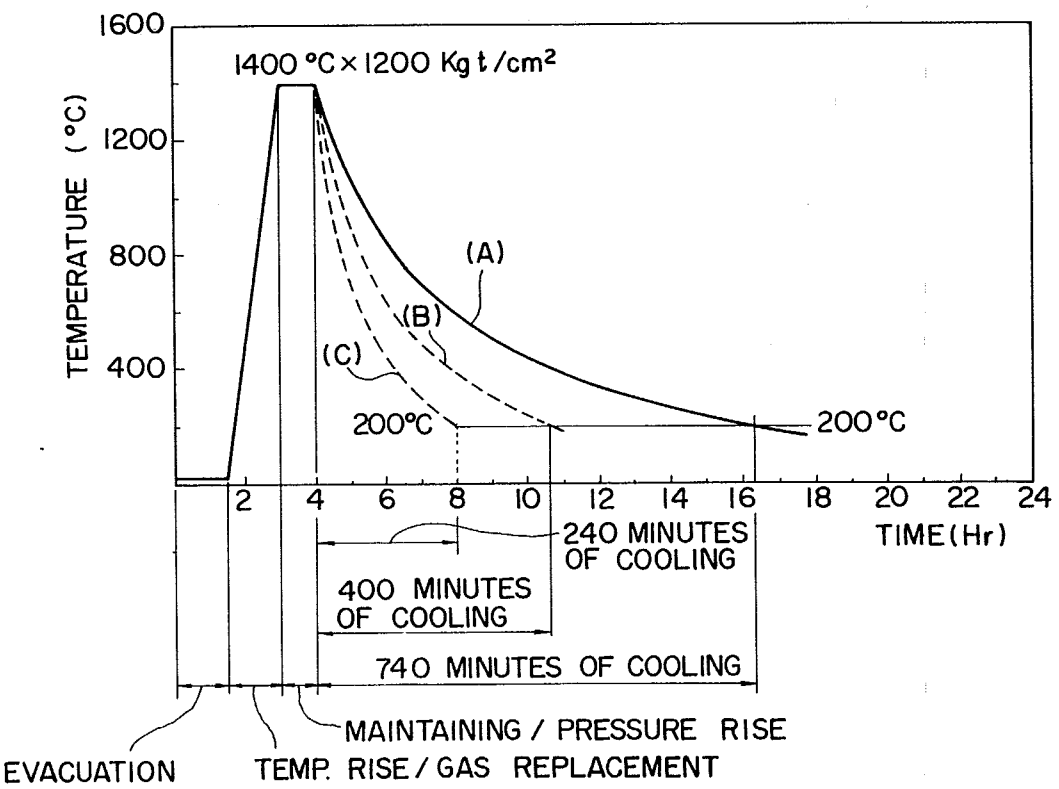
FIG. 5 is a diagram showing a comparison between the apparatus of the invention and a conventional apparatus with respect to the cooling time in the HIP treatment.

Next, in order to confirm the cooling efficiency in the HIP treatment using the HIP apparatus of the invention embodied above, a comparison was made with a conventional HIP apparatus provided with a heat insulating layer having no convectional action, the results of which are as shown in FIG. 5.

More particularly, a work piece weighing 1300 kg. was subjected to HIP treatment at 1400° C. and 1200 kgf/cm$^2$, and then cooled. The time required for cooling from 1400° C. to 200° C. was 740 minutes in the conventional apparatus (A), while being 400 minutes in the apparatus (B) of the invention shown in FIG. 1 and 240 minutes in the apparatus (C) of the invention shown in FIG. 3, thus realizing a remarkable shortening of the cooling time in the apparatus of the invention. As a practical matter, this indicates an improvement in productivity on the order of two or three charges a day as compared with one charge a day in the prior art.

As set forth hereinabove, in the apparatus of the present invention, unlike the conventional heat insulating layer construction, gas passages are formed in the upper surface and lower portion of the heat insulating layer, and a valve is provided in the passage in the upper surface of the heat insulating layer so that it can be opened and closed to correspondingly open and close the same passage. And in the cooling step which follows the HIP treatment, the valve is opened to thereby form a convection route for the high temperature gas in the high pressure chamber, through which route the gas flows into the heat insulating layer from the lower gas passage, then flows out of the heat insulating layer from the upper passage which is now open, and again flows down to the lower portion while being cooled by the inner surface of the high pressure vessel. Therefore, the cooling efficiency is much higher than that in the conventional HIP apparatus having a heat insulating layer of the conventional type. Besides, as will be clearly seen from the results of comparison shown in FIG. 5, the cooling time can be shortened to a large extent, which greatly contributes to improvement of productivity, and the rationalization of the cooling step which has been one of the problems encountered in the attempt for process improvement in HIP treatment can be attained, thereby remarkably improving the utility value of the HIP apparatus.

It goes without saying that during the treatment at high temperature and pressure the valve in the upper gas passage is closed so as to suppress the convection of gas in the heat insulating layer, thereby permitting a good heat insulating performance to be exhibited.

What is claimed is:

1. A hot isostatic pressing apparatus, comprising:
a high pressure vessel having an upper and lower cover defining a high pressure chamber;
a heat insulating layer positioned within said high pressure chamber of said vessel;
a heater disposed inside said high pressure chamber wherein said heat insulating layer further comprises at least an inner and outer inverted cup-like casing and a layer of insulation positioned between said inner and outer casing, the outer casing being metallic wherein an upper passage means formed in the upper surface of the outer casing;
valve means positioned in said upper passage means so as to open and close said passage;
means mounted on said upper cover for opening and closing said valve means wherein said outer casing includes a lower gas passage means for providing communication from said lower gas passage means through said insulation and through said upper passage means; and
means for hermetically sealing and interconnecting a lower end portion of said inner casing to said lower end portion of said outer casing.

2. A hot isostatic pressing apparatus according to claim 1, wherein said heat insulating layer further comprises a middle inverted cup-like casing, and gas passage means formed in an upper surface portion of said middle casing.

3. A hot isostatic pressing apparatus according to claim 1, wherein said heat insulating layer further comprises a middle inverted cup-like casing, and gas passage formed in an upper portion of said middle casing.

4. A hot isostatic pressing apparatus according to claim 3, which further comprises a heat insulating material packed between said casings.

5. A hot isostatic pressing apparatus, comprising:
a high pressure vessel having an upper and lower cover defining a high pressure chamber;
a heat insulating layer positioned within said high pressure chamber of said vessel;
a heater disposed inside said high pressure chamber wherein said heat insulating layer further comprises at least an inner and outer inverted cup-like casing and a layer of insulation positioned between said inner and outer casing, the outer casing being metallic and wherein an upper passage means is formed in the upper surface of the outer casing;
valve means positioned in said upper passage means so as to open and close said passage;
a ring member interconnecting a lower portion of said inner and outer casing; and
means mounted on said upper cover for opening and closing said valve means wherein said ring member includes a lower gas passage means for providing communication from said lower gas passage means through said insulation and through said upper passage means.

* * * * *